US005785214A

United States Patent [19]

Smrt

[11] Patent Number: 5,785,214

[45] Date of Patent: Jul. 28, 1998

[54] MOVABLE MARKING DEVICE FOR HOLDING AND AGITATING AN AEROSOL CONTAINER

[76] Inventor: Thomas J. Smrt, 10014 S. Grant Hwy., Marengo, Ill. 60152

[21] Appl. No.: 766,042

[22] Filed: Dec. 16, 1996

[51] Int. Cl.[6] ..... B05B 1/28

[52] U.S. Cl. ..... 222/609; 222/402.1; 239/150; 366/209

[58] Field of Search ..... 222/192, 608, 222/609, 610, 402.1; 239/150, 273, 337; 366/209

[56] References Cited

U.S. PATENT DOCUMENTS

| | | | |
|---|---|---|---|
| 3,239,147 | 3/1966 | Sweet | 239/150 |
| 3,796,353 | 3/1974 | Smrt | 222/609 |
| 3,871,557 | 3/1975 | Smrt | 222/609 |
| 5,287,998 | 2/1994 | Smrt | 239/337 |

FOREIGN PATENT DOCUMENTS

| | | | |
|---|---|---|---|
| 1103505 | 6/1981 | Canada | 239/150 |
| 2045318 | 10/1980 | United Kingdom | 222/609 |

*Primary Examiner*—Joseph Kaufman

*Attorney, Agent, or Firm*—Leydig, Voit & Mayer, Ltd.

[57] ABSTRACT

A device for discharging the contents of an aerosol container onto a surface, wherein the device is capable of holding and agitating a spare aerosol container is provided. The device comprises a first aerosol container holder disposed on a housing. The first aerosol container having an actuator mounted on the container that moves between discharging and non-discharging positions. The device further including an actuator which effects movement of the aerosol container actuator between the discharging and non-discharging positions and a trigger for controlling the, actuator which allows an operator to discharge the contents of the aerosol container onto the surface. The device also having at least one rotatable wheel disposed on the housing which rotates as the device is moved relative to the surface and a second container holder disposed on the wheel for holding a second aerosol container.

8 Claims, 2 Drawing Sheets

MOVABLE MARKING DEVICE FOR HOLDING AND AGITATING AN AEROSOL CONTAINER

FIELD OF THE INVENTION

This invention generally relates to movable devices for discharging the contents of aerosol containers onto a surface and thereby marking that surface.

BACKGROUND OF THE INVENTION

The use of aerosol containers for dispensing marking compositions is well-known, e.g., for marking or striping parking lots, construction sites, sporting fields, and factory floors. In order to assist in this process, a number of devices have been developed for use with aerosol containers which allow a person making such marks or stripes to remain relatively upright, while at the same time the container is positioned relatively close to the surface to be marked. These devices further allow the discharge of the marking compositions from the container to be controlled by the user. Examples of these types of devices are provided by U.S. Pat. Nos. 4,895,304, 5,148,988, 5,368,202 and pending U.S. patent application Ser. No. 08/298,418.

With each of these devices, once the container's supply of marking composition is exhausted, it must be removed and replaced. Before the new container of marking composition can be inserted into the marking device, however, it typically must be shaken vigorously in order to ensure thorough distribution of the marking composition components within the container. This shaking the of a new container is not only time consuming, but can be tiring.

Accordingly, a need exists for a device which overcomes the foregoing problems.

SUMMARY OF THE INVENTION

The present invention satisfies the aforesaid and other needs by providing a device for discharging the contents of an aerosol container onto a surface, wherein the device is capable of holding and agitating a spare aerosol container. The device comprises a housing; means disposed on the housing for holding a first aerosol container having an actuator mounted on the container that moves between discharging and non-discharging positions; actuating means which effects movement of the aerosol container actuator between the discharging and non-discharging positions; means disposed on the device for controlling the actuating means which allows an operator to discharge the contents of the aerosol container onto the surface; at least one rotatable wheel disposed on the housing which rotates as the device is moved relative to the surface; and means disposed on the wheel for holding a second aerosol container.

These and other features and advantages of the invention will be more readily apparent upon reading the following description of preferred embodiments of the invention and upon reference to the accompanying drawings.

While the present invention will be described and disclosed in connection with certain preferred embodiments and methods, it is not intended that the invention be limited to those specific embodiments. Rather, it is intended that the present invention cover all such alternative embodiments and modifications that fall within the spirit and scope of the present invention.

DETAILED DESCRIPTION OF THE PREFERRED EMBODIMENTS

In accordance with one embodiment of the present invention, there is provided a device for discharging the contents of an aerosol container onto a surface which is capable of holding and agitating a spare container while the device is being operated, thereby eliminating the need for the operator to manually agitate the spare container prior to using it to replace the original discharging container. The present invention provides a relatively simple mechanism wherein the movement of the aerosol container discharging device over the surface is translated into agitation of a spare container.

Figure 1:
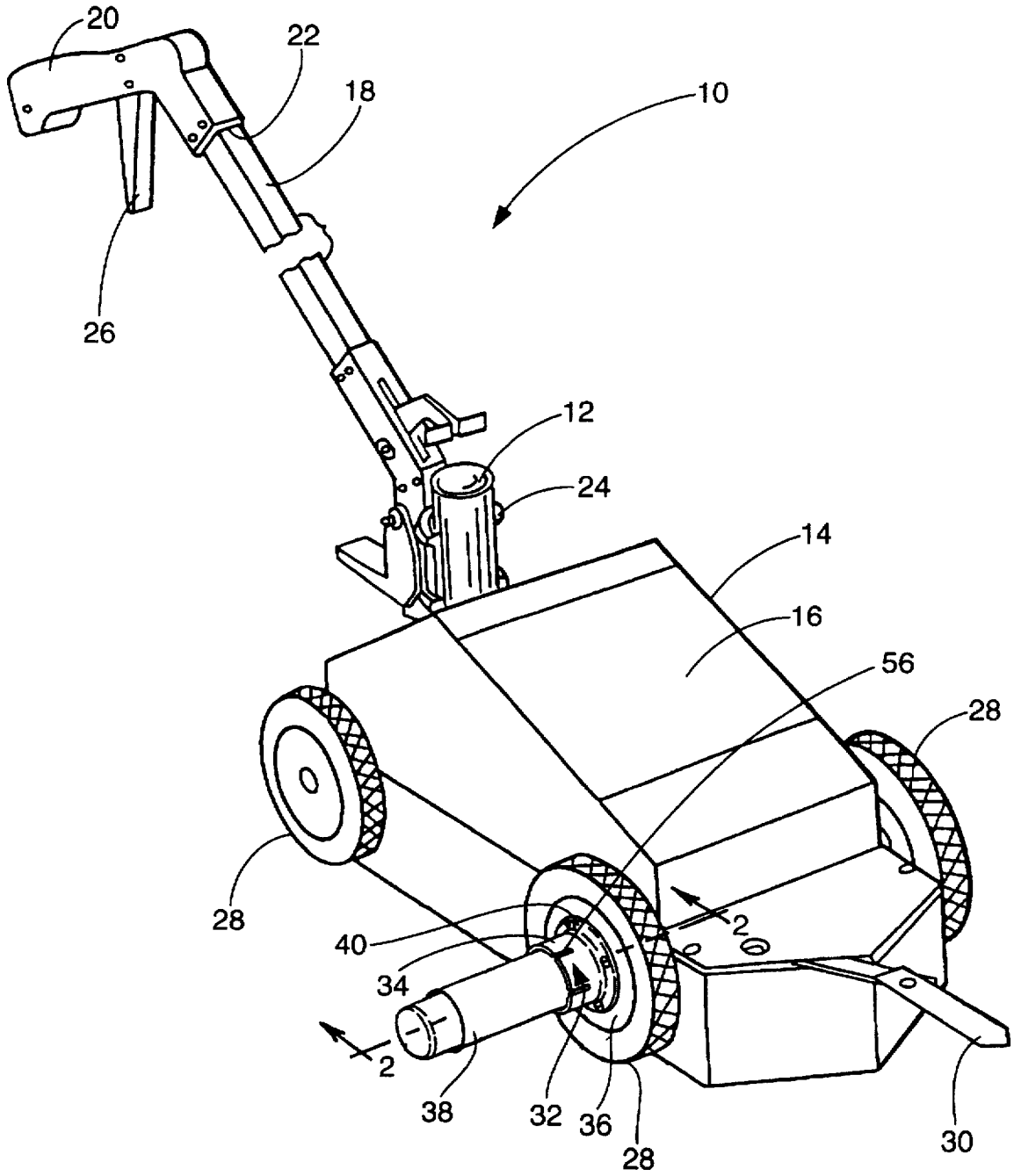
FIG. 1 is a perspective view of an aerosol container discharging device capable of holding and agitating a spare aerosol container constructed according to one preferred embodiment of the present invention.

Turning initially to FIG. 1, there is illustrated one preferred embodiment of the device 10 of the present invention shown in use with a conventional aerosol container 12 designed to be discharged in the inverted position. The aerosol container 12 includes an actuator mounted thereon (not shown) that moves between discharging and non-discharging positions, thereby controlling the discharge of the contents of the aerosol container 12.

The device 10 includes a housing 14 on or within which the various components of the device are disposed. In the embodiment illustrated in FIG. 1, the housing 14 comprises a relatively hollow body portion 16 to which is attached a handle 18. A handle grip 20 for manual grasping by the user of the device is disposed at the top end 22 of the handle 18. Means for receiving and holding an aerosol container 12 is disposed on the housing 16. In the illustrated embodiment of FIG. 1, the container holding means comprises a generally semi-cylindrical structure 24 which is sized to receive an inverted aerosol container. Within the container holder 24 is an annular flange (not shown) adapted to engage a ridge portion on the aerosol container thereby properly positioning and retaining the aerosol container within the semi-cylindrical structure 24. As is well known, the flange should be located on the container holder 24 so the actuator is located at a distance from the surface so that the desired mark or stripe is provided thereon. This positioning, of course, can be varied to provide for the results desired, as will be appreciated by those skilled in the art.

The device 10 also includes an actuating means which moves the aerosol container actuator between discharging and non-discharging positions. In the embodiment shown in FIG. 1, the actuating means comprises an actuator rod (not shown) that is mounted on the device and is movable relative to the aerosol container disposed in the aerosol container holder 24. In this way, the actuating means can be moved between a discharging position, wherein the actuator means effects movement of the aerosol container actuator into the discharging position, and a non-discharging position wherein the actuator is not moved into the discharging position.

In the case of the aerosol containers used with the embodiments disclosed herein, when an operator desires to mark a surface, the actuating means must displace the actuator sideways, thus opening the spring-biased valve of the container and providing for discharge of the marking composition from the container. When the actuating means is retracted, the actuator will return to its former position and the spring-biased valve will re-close, halting the discharge.

The device 10 further includes means for controlling the movement of the actuating means, and thereby the aerosol container actuator, between the discharging and non-discharging positions. As exemplified in FIG. 1, the control means comprises a triggering mechanism which includes a spring-biased trigger 26 that is disposed adjacent the top end 21 of the handle 18 near the handle grip 20. The trigger 26 is attached to and controls the movement of an actuating means, which in the embodiment illustrated in FIG. 1 comprises a trigger rod (not shown). The embodiment illustrated in FIG. 1 also optionally includes a pointer 30 which can be used by the operator as an aid moving the device along a desired path.

As will be appreciated by one of ordinary skill, there are a number of component configurations by which the container actuator can be displaced, and any of those can be used in the embodiments disclosed and claimed herein.

The device further comprises at least one wheel 28 which is disposed on the device 10. As exemplified in FIG. 1, the device includes four wheels 28 which are rotatably mounted to the housing 16. While the embodiment illustrated in FIG. 1 has four wheels, those skilled in the art will appreciate that the present invention is equally applicable to any aerosol container discharging device which has one or more wheels which enable it move over a surface which is to be marked.

In accordance with one important aspect of the present invention, the device 10 further includes means for holding and agitating a second or spare aerosol container 38. In one preferred embodiment of the invention, as shown in FIGS. 1–4, the means for holding and agitating the spare container 38 comprises a second or spare container holder 32 mounted on one of the wheels 28 of the device 10. As will be well appreciated by those skilled in the art, this wheel may ride directly on the surface over which the device travels, or may be rotated directly or indirectly by a wheel that rides directly on the surface.

Thus, as the operator of the device 10 moves the device over a surface to be marked, the mere turning of the wheel will result in the agitation of a spare container being held in the spare container holder.

Figure 2:
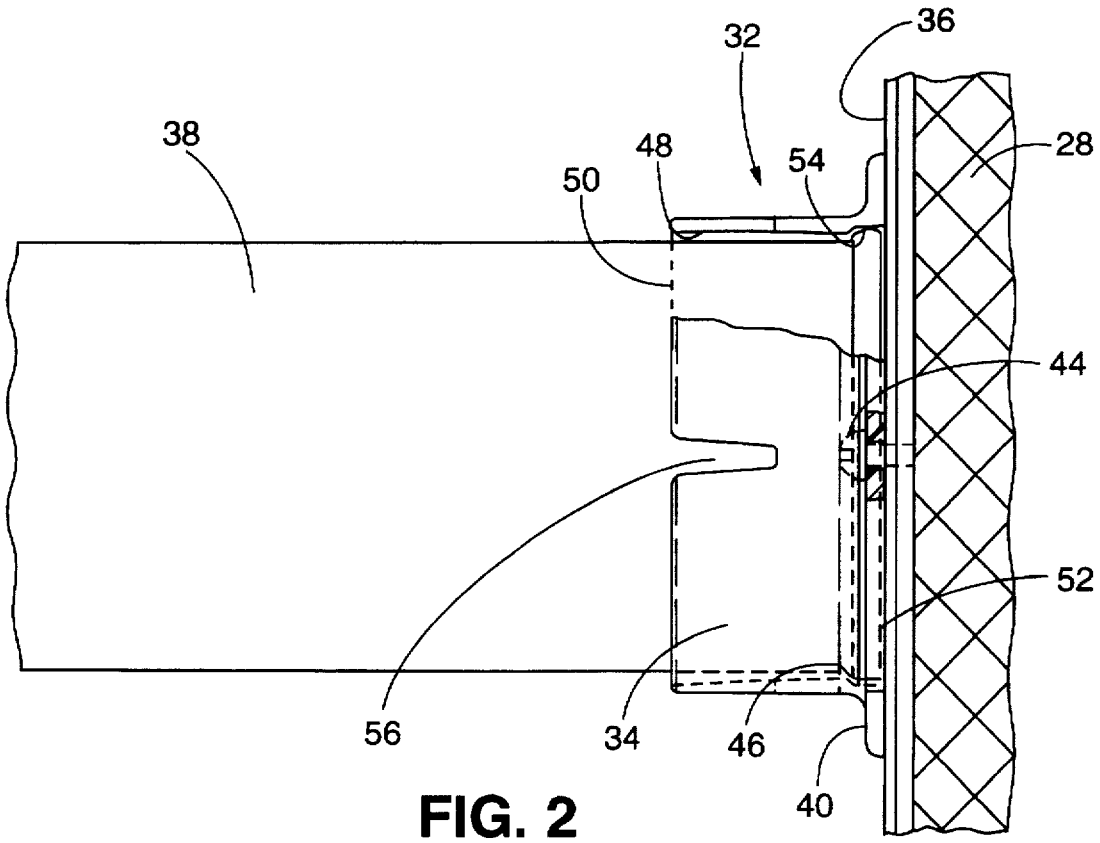
FIG. 2 is a cross-sectional view taken along line 2—2 in FIG. 1 illustrating the engagement of the aerosol container with the spare container holder.
Figure 3:
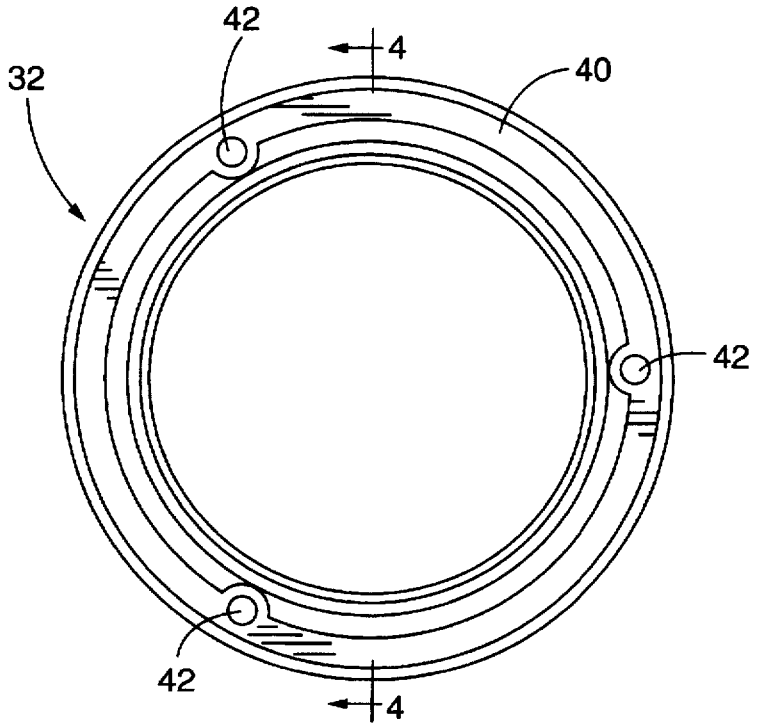
FIG. 3 is a side view of the aerosol container spare container holder of FIG. 1.
Figure 4:
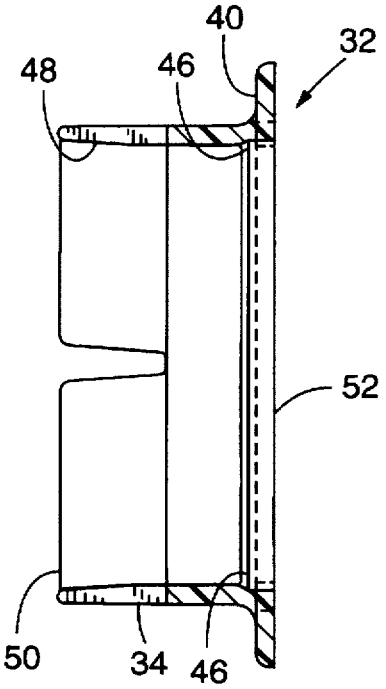
FIG. 4 is a cross-sectional view taken along line 4—4 in FIG. 3.

As best shown in FIGS. 2 and 3, in one embodiment of invention, the spare container holder 32 may be configured as a generally cylindrical structure 34 which can retain and hold a spare container 38 such that the container extends generally perpendicular to the hub 36 of the wheel 28. Viewed in another perspective, the longitudinal axis of the aerosol container is oriented parallel to the longitudinal axis of the axle to which the wheel is rotatably mounted. As shown in FIGS. 2 and 3, the spare container holder 32 further includes an annular collar 40 having at least one hole 42 therein which allows the spare container holder 32 to be attached to the hub 36 of one of the wheels via any suitable fastening means, such as the illustrated screws 44. Those skilled in the art will appreciate that while the illustrated embodiments of the invention show the cylindrical structure mounted at the center of the wheel 28, in other embodiments the cylindrical structure could be mounted off-center, e.g., eccentrically, on the wheel.

In order to ensure that the spare container 38 is securely held and retained, the spare container holder 32 is adapted such that a spare container can be held within the cylindrical structure 34 by a relatively tight friction fit. In the embodiment illustrated in FIGS. 1–4, the cylindrical structure 34 includes a ridge portion 46 and a tapered side wall 48 which help to achieve the desired friction fit. In particular, as best shown in FIG. 2, the side wall 48 of the cylindrical structure is tapered such that the diameter of cylindrical structure decreases as the wall runs from the open end 50 toward the wheel hub end 52 of the cylindrical structure. The annular ridge 46 is formed on the inner side wall of the cylindrical structure adjacent the wheel hub end 52. This annular ridge 46 is configured to engage the ridge 54 that is typically formed at the base of an aerosol container, thereby positively locking the container into the spare container holder.

In addition, and in order to help the spare container holder accommodate containers of varying sizes, one preferred embodiment of the spare container holder 32 includes at least one slit 56 which enables the cylindrical structure 34 to expand to accommodate slightly larger containers. As best shown in FIGS. 1 and 3, the spare container holder 32 includes three such slits 56 which run axially in the circumferential surface of the cylindrical structure 34.

While the components of the foregoing devices which allow a user to control the discharge of the aerosol container held at a remote distance from the user have been described herein in connection with certain preferred embodiments, those skilled in the art will appreciate that the present invention is equally applicable to other aerosol container discharging devices.

All of the references cited herein, including patents, patent applications, and publications, are hereby incorporated in their entireties by reference.

While the present invention has been described with an emphasis upon preferred embodiments, it will be obvious to those of ordinary skill in the art that variations of the preferred embodiments disclosed herein may be used and that it is intended that the invention may be practiced otherwise than as specifically described herein. Accordingly, this invention includes all modifications encompassed within the spirit and the scope of the invention as defined by the following claims.

What is claimed is:

1. A device for discharging the contents of a first aerosol container onto a surface and for holding and agitating a second aerosol container comprising a housing;

means disposed on the housing for holding a first aerosol container, wherein the container has an actuator mounted on the container that moves between discharging and non-discharging positions;

actuating means which effects movement of the aerosol container actuator between the discharging and non-discharging positions;

means disposed on the device for controlling the actuating means which allows an operator to discharge the contents of the aerosol container onto the surface;

at least one rotatable wheel disposed on the device which rotates as the device is moved relative to the surface; and means disposed on the wheel for holding a second aerosol container.

2. The device of claim 1 wherein the wheel has a hub and the means for holding a second aerosol container comprises a generally cylindrical structure having a longitudinal axis, the cylindrical structure being mounted on the wheel such that the longitudinal axis of the cylindrical structure is perpendicular to the hub of the wheel.

3. The device of claim 2 wherein the cylindrical structure is mounted to the center of the wheel hub.

4. The device of claim 2 wherein the cylindrical structure is mounted eccentrically on the wheel hub.

5. The device of claim 2 wherein the cylindrical structure includes an annular ridge therein.

6. The device of claim 2 wherein the cylindrical structure includes a tapered side wall.

7. The device of claim 2 wherein the cylindrical structure includes a side wall with at least one slit therein.

8. A device for discharging the contents of a first aerosol container onto a surface and for holding and agitating a second aerosol container comprising a housing;

means disposed on the housing for holding a first aerosol container, wherein the container has an actuator mounted on the container that moves between discharging and non-discharging positions;

actuating means which effects movement of the aerosol container actuator between the discharging and non-discharging positions;

means disposed on the device for controlling the actuating means which allows an operator to discharge the contents of the aerosol container onto the surface;

at least one rotatable wheel disposed on the device which rotates as the device is moved relative to the surface;

a generally cylindrical structure mounted on the wheel for holding a second aerosol container; and a second aerosol container disposed in the generally cylindrical structure mounted on the rotatable wheel.

* * * * *